US010548407B2

(12) United States Patent
Polevoy et al.

(10) Patent No.: US 10,548,407 B2
(45) Date of Patent: Feb. 4, 2020

(54) WRAP AROUND BED FRAME

(71) Applicants: Richard S. Polevoy, Teaneck, NJ (US); Paul E. Carlson, Skaneateles, NY (US); Michael W. Konieczny, Skaneateles, NY (US); Robert L. Naas, Skaneateles, NY (US)

(72) Inventors: Richard S. Polevoy, Teaneck, NJ (US); Paul E. Carlson, Skaneateles, NY (US); Michael W. Konieczny, Skaneateles, NY (US); Robert L. Naas, Skaneateles, NY (US)

(73) Assignee: Finger Lakes Intellectual Property, LLC, Teaneck, NJ (US)

( * ) Notice: Subject to any disclaimer, the term of this patent is extended or adjusted under 35 U.S.C. 154(b) by 839 days.

(21) Appl. No.: 14/605,070

(22) Filed: Jan. 26, 2015

(65) Prior Publication Data

US 2015/0208811 A1 Jul. 30, 2015

Related U.S. Application Data

(60) Provisional application No. 61/931,278, filed on Jan. 24, 2014.

(51) Int. Cl.
*A47C 19/02* (2006.01)
*A47C 19/00* (2006.01)

(52) U.S. Cl.
CPC ..... *A47C 19/025* (2013.01); *A47C 19/005* (2013.01); *Y10T 29/49826* (2015.01); *Y10T 29/49876* (2015.01)

(58) Field of Classification Search
CPC ..... A47C 19/00; A47C 19/005; A47C 19/021; A47C 19/025; Y10T 29/498526; Y10T 29/49876
See application file for complete search history.

(56) References Cited

U.S. PATENT DOCUMENTS 598,594 A * 2/1898 Colleran ..... F16B 12/58 5/132
660,196 A * 10/1900 Myers ..... F16B 12/58 213/171
1,851,282 A * 3/1932 Jacobs ..... F16B 12/60 5/286
2,636,189 A * 4/1953 Feldman ..... A47D 13/06 16/DIG. 2
3,537,114 A * 11/1970 Mis ..... A47C 19/005 5/201

(Continued)

*Primary Examiner* — David R Hare
(74) *Attorney, Agent, or Firm* — Hoffmann & Baron, LLP

(57) ABSTRACT

A wrap around bed frame for use in supporting a box spring and mattress having side rails and cross members and a foot member that is affixed to the foot ends of the side rails to provide support for the foot end of the bedding. The entire bed frame can be assembled with fittings that do not require tools for assembly and thus, the bed frame can be assembled easily by the user by simply sliding or snapping the components together. Protective shields cover the bed frame so as to minimize harm to a person inadvertently striking one of the bed frame components. The foot member is comprised of an upper and lower member affixed together. There are also center wedges on the cross members where a foot can be affixed to the center wedge to facilitate assembly of the bed frame.

12 Claims, 6 Drawing Sheets

(56) References Cited

U.S. PATENT DOCUMENTS 3,761,971 A * 10/1973 Behnke ..... A47C 19/024 403/187
4,007,502 A * 2/1977 Mis ..... A47C 19/005 5/184
4,263,683 A * 4/1981 Knoke ..... A47C 19/04 5/200.1
5,522,101 A * 6/1996 Yeh ..... A47C 19/005 403/334
5,740,568 A * 4/1998 Elliott ..... A47C 19/005 5/295
6,397,412 B1 * 6/2002 Quintile ..... A47C 19/024 5/200.1
6,826,790 B1 * 12/2004 Polevoy ..... A47C 19/024 248/345.1
6,941,596 B2 * 9/2005 Schuman ..... A47C 19/024 5/200.1
7,100,228 B2 * 9/2006 Polevoy ..... A47C 19/021 5/424
7,219,378 B2 * 5/2007 Polevoy ..... A47C 19/024 5/200.1
7,644,456 B2 * 1/2010 Polevoy ..... A47C 19/005 5/201
7,654,184 B2 2/2010 Polevoy et al.
7,874,027 B2 1/2011 Polevoy et al.
8,832,876 B1 * 9/2014 Oh ..... A47C 17/64 5/116
9,247,825 B2 * 2/2016 Polevoy ..... A47C 19/005
9,730,523 B2 * 8/2017 Bartelsmeyer ..... A47C 19/04
D808,700 S * 1/2018 Bartelsmeyer ..... D6/718
2003/0200608 A1 * 10/2003 Polevoy ..... A47C 19/005 5/201
2007/0044235 A1 * 3/2007 Navarro ..... A47C 19/005 5/201
2010/0242171 A1 * 9/2010 Polevoy ..... A47C 19/005 5/282.1
2011/0289682 A1 * 12/2011 Lee ..... A47C 19/126 5/202

* cited by examiner

WRAP AROUND BED FRAME

RELATED APPLICATION

The present application claims benefit under 35 U.S.C. § 119(e) of U.S. Provisional Application No. 61/931,278, filed Jan. 24, 2014, the contents of which is hereby incorporated by reference in its entirety.

FIELD OF THE INVENTION

The present invention relates to a bed frame for supporting a mattress or mattress set and, more particularly, to a wrap around bed frame that includes a foot member to provide an all around support to a mattress and bedding.

BACKGROUND OF THE INVENTION

With a conventional bed frame, there normally are two side rails that are placed in a parallel orientation with respect to each other and one or more cross members that span between the side rails to provide support to the box spring and mattress. The sides of the box spring are support by a horizontal flange of the side rails and the internal area of the box spring and mattress are supported by the cross members.

With many bed frames, the side rails and cross members are made of a metal, generally steel, and are comprised of steel angle irons. As a recent innovation, the side rails can also be comprised of angle irons joined together to form a T-shaped member or can be constructed and used as single, unitary T-shaped steel components.

With a typical steel bed frame, the foot ends of the side rails extend beyond any supporting legs such that the foot ends of the side rails extend in cantilever manner outwardly beyond the supporting legs and there is no further component, such as a foot supporting member that provides support for the foot ends of the side rails.

There is currently a trend of not having a foot board at the foot end of the bed. The absence of a footboard not only reduces support at the foot end of the bed but eliminates the pleasing and decorative component that would normally cover and enclose the foot end bedding and give the overall foot end of the completed bed a pleasing appearance.

As such, the foot end of the box spring and mattress are basically unsupported and a weight placed at that end, such as by a person sitting on the very end of a mattress, can create bending and cause damage to the bed frame. This is particularly true of a king size bed frame where there may be two box springs or foundations used in a side by side relationship and, in such instance, there is a decided lack of support at the center of the bed where the two box springs or foundations come together.

Another difficulty with present bed frames is that there is a certain amount of labor used in securing the frame members together, that is, the metal components are affixed together by hand and often require hand tools to complete the assembly of a bed frame. As such, since the initial set up of a bed frame is normally carried out by a delivery person who may have multiple deliveries on the same day, the amount of time used to complete the set up of the bed frame is important and, obviously, there an advantage in being able to assemble the bed frame quickly and accurately in as little time as possible.

A further difficulty with current bed frames is that the metal structural components have sharp edges and joints and the presence of those sharp edges can cause tearing of the linen, bed spreads or other bed coverings used with the bed.

Accordingly, it would be advantageous to provide a metal bed frame where the foot ends of the side rails are connected to a foot member to form an aesthetically pleasing design that visually provides a smooth continuation of the side rails that transition to the foot member as well as provide support to the foot end of a box spring and mattress.

It would be further advantageous to have a bed frame that was easily assembled without the need for tools or specialized skill and which was fully protected by some shields to cover any sharp edges or corners to prevent tearing or damage to the bed coverings.

SUMMARY OF THE INVENTION

In accordance with the present invention, there is a bed frame assembly that is used to support a box spring and mattress and which has side rails having a horizontal surface to support the sides of the box spring. There is at least one, and normally multiple, cross members to aid in the support of the box spring and mattress and which span the distance between the side rails.

At the foot ends of the side rails, there is a foot member that is connected by an affixation system so that the overall bed frame is a wrap around design that includes the foot member to support the foot end of the box spring and mattress.

In all, the foot member is affixed to the foot ends of the side rails by a simple affixation system that eliminates the need for tools to carry out that connection. In addition, the cross members can also be affixed to the side rails in the assembly of a bed frame without the need for tools. As such, the entire bed frame is readily assembled without tools since all of the components of the bed frame either drop in, snap in or slide into the desired positions in the assembly of the bed frame.

The cross members include center legs that are easily and without tools simply snapped on to the bed frame during assembly. The foot member itself comprises a multi-component structural member that is preferable preassembled for the user by the manufacturer and, again, is simply is connected by an easy assembly step without tools. Upon assembly of the foot member to the side rails, a pleasing appearance is maintained by included movable slides that can be slid into place to cover gaps between the foot member and the side rails.

While the following description of the invention relates to the presence of a foot member to support the foot end of the bed frame, it can be seen that a similar feature could be added to the head end of the bed frame, that is, the use of a head member that is affixed by means of a wedge and receiver to the head ends of the side rails to replace head board brackets that normally are present at the head end of the side rails. Thus, the headboard itself would be eliminated and the head end of the bed would be finished off in the same manner as the foot end as described herein.

These and other features and advantages of the present invention will become more readily apparent during the following detailed description taken in conjunction with the drawings herein.

DETAILED DESCRIPTION OF THE INVENTION

Figure 1:
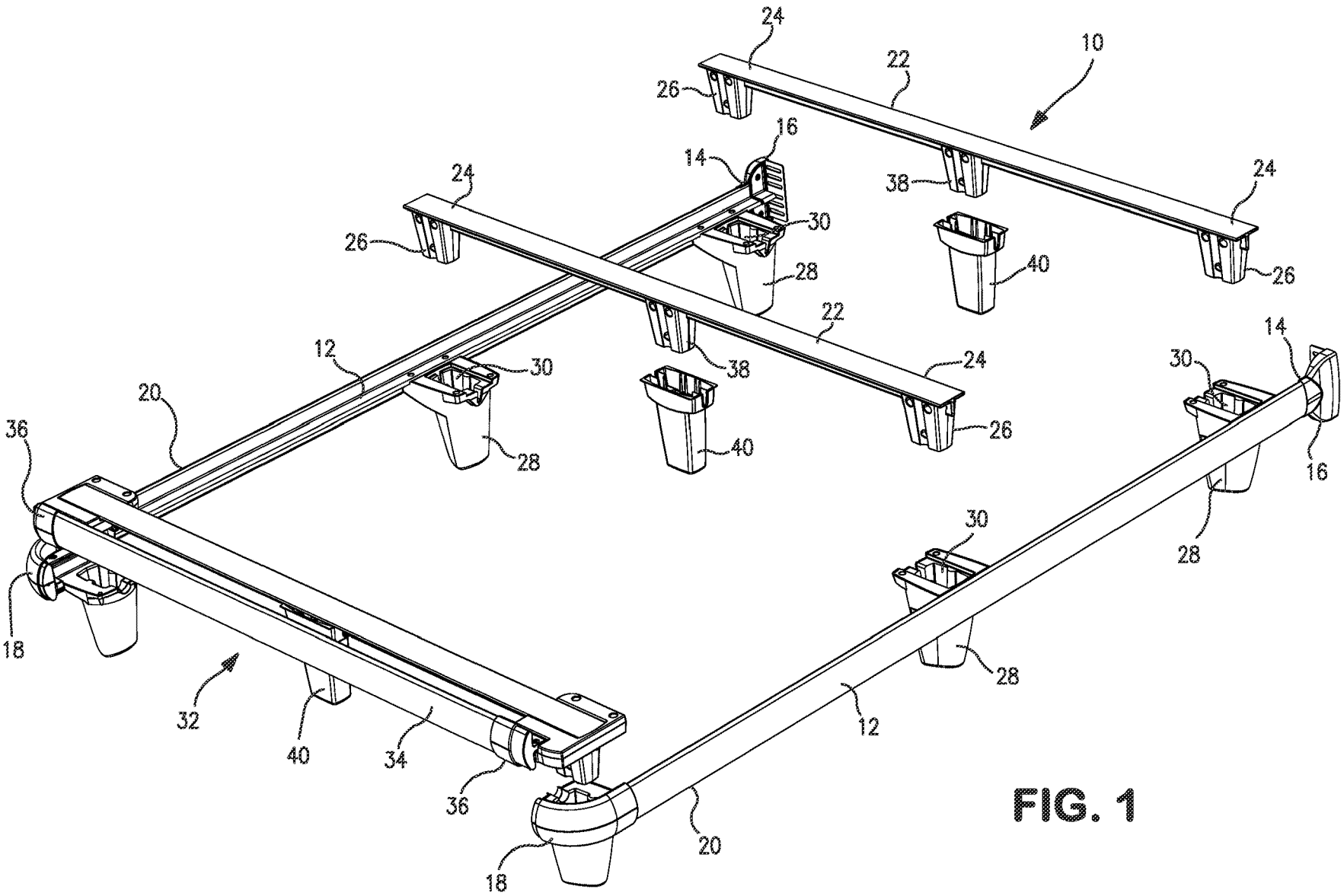
FIG. 1 is an exploded view illustrating an exemplary bed frame of the present invention.

Turning first to FIG. 1, there is shown an exploded view of a bed frame 10 constructed in accordance with the present invention. As can be seen in FIG. 1, the bed frame 10 is comprised of two side rails 12 that are oriented parallel to each other and support the side edges of a box spring and mattress. In the illustrated embodiment of FIG. 1, each of the side rails 12 is made up of L-shaped angle irons affixed together to produce a T-shaped structural member, however, the side rails 12 can also be other configurations, such as L-shaped angle irons or T-shaped members as shown and described in U.S. Pat. No. 7,954,184 of Polevoy et al. and the disclosure of the '184 patent is hereby incorporated herein in its entirety by reference.

As will be described herein, the side rails 12 in the construction of the bed frame 10, have head ends 14 which are defined, and will be herein referred to, as the location where the head of the user is positioned and which normally will include head end brackets 16 for being affixed to a head board (not shown). The opposite ends of the side rails 12 are defined as the foot ends 18 where the feet of the user are designed to be located when the user is lying supine on the bed. As can be seen, the foot ends 18 in the exemplary embodiment are curved.

The side rails 12 can have protective shields 20 affixed thereto to create an esthetically pleasing appearance as well as provide protection against potential damage by ripping or tearing of the bed coverings through the encountering of an end or corner of an angle iron that forms the side rails 12. The protective shields 20 can be constructed and assembled to the side rails 12 in accordance with that shown and described in U.S. Pat. No. 7,874,027 and the disclosure of the '027 patent is hereby incorporated herein in its entirety by reference.

There can also be seen, cross members 22 that have their ends 24 affixed to the side rails 12 and span the distance therebetween. At the ends 24 of each of the cross members 22, there is an end wedge 26 formed and which interfits into a receiver 28 having a cavity 30 formed therein. The receivers 28 are affixed to each of the side rails 12. The use of an end wedge and receiver is shown and described in U.S. Application Publication No. 2010/0242171 of Polevoy et al. and the disclosure of the '171 publication is hereby incorporated herein by reference in its entirety.

A foot member 32 is present that is affixed to the foot ends 18 of the side rails 12 by means of an affixation system. The foot member 32 includes a protective shield 34 that covers the external surface of the foot member 32 and may be of the type shown and described in the aforementioned '027 patent of Polevoy et al. In addition, the foot member 32 includes movable slides 36 located at the opposed ends of the foot member 32 and the purpose of the movable slides 36 will be later explained.

As also can be seen in FIG. 1, the cross members 22 have a center wedge 38 that extends downwardly from each of the cross members 22 in a similar manner to the end wedges 26. As such, when the bed frame 10 is assembled, a center leg 40 can be affixed to each of the center wedges 38 so that the center legs 40 can contact the support surface such as the floor and support the bed frame 10 at the center thereof. As will become clear, the assembly of the center legs 40 is carried out by simply sliding a center leg 40 onto each center wedge 38 such that center leg 40 snaps on to the center wedge 38 to be retained in that affixed position.

Figure 2:
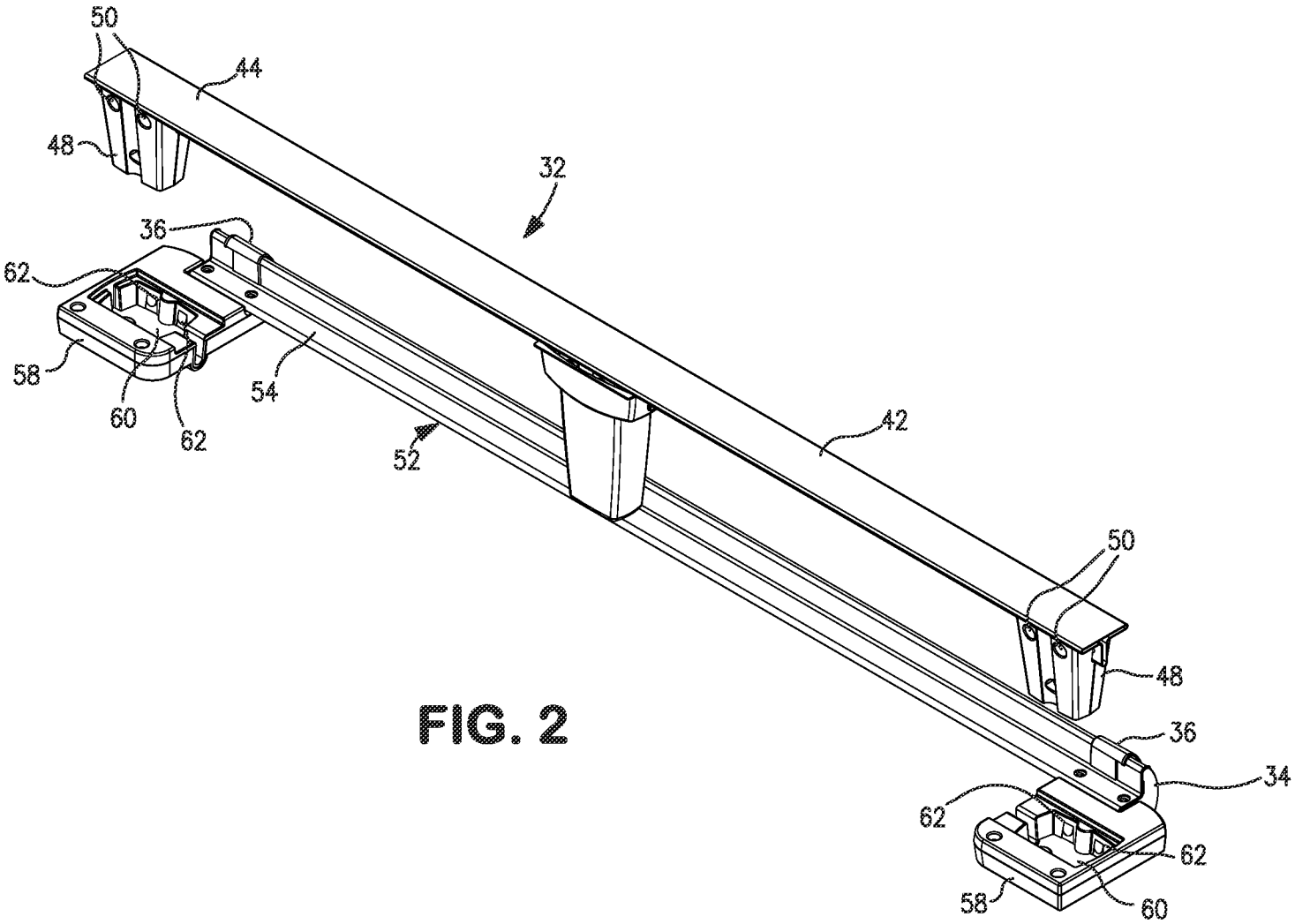
FIG. 2 is an exploded view illustrating the assembly of the foot member of the bed frame of FIG. 1.

Turning then to FIG. 2, taken along with FIG. 1, there is shown an exploded view of the foot member 32 and illustrating its assembly. It should be noted that the assembly of the foot member 32 is preferably carried out by the manufacturer of the bed frame rather than by the ultimate user on site, however, it could be done by the user. As such, the foot member 32 is comprised of an upper member 42 that is the same as a cross member 22, however the upper member 42 will be referred to by different identification numbers to better explain its particular function in forming a foot member 32. As such, the upper member 42 is a T-shaped iron member having an upper flat flange 44 and a center, downwardly extending flange 46 (see FIG. 4).

A pair of foot end wedges 48 are affixed to the opposed ends of the upper member 42 and may be affixed thereto by means of rivets. As can also be seen, with the use of rivets, there are formed holes 50 in the foot end wedge 48, the purpose of which will be later explained. As seen in FIG. 2, there are two holes 50, however, there are an additional two holes formed on the opposed side of the foot end wedge 48 and are not shown in FIG. 2. In effect, the opposite side of the foot end wedge 48 is a mirror image of the side shown in FIG. 2. Again, to facilitate the manufacture of the overall bed frame 10, the upper member 42 as well as the foot end wedges 48 and other features of the upper member 42 are the same as the cross members 22 as well as the assembly of center legs 40 that are slid onto the center wedge (not identified in FIG. 2) such that center leg 40 snaps on to the center wedge of the upper member 42 in the same manner as with the center legs 40 of the cross members 22.

The foot member 32 is further comprised of a lower member 52 that is made of an angle iron 54 that is covered by the protective shield 34 and which includes the movable slide 36. A pair of corner decks 58 is affixed to the opposed ends of the angle iron 54 by means such as rivets and each corner deck 58 has an opening 60 therethrough.

Accordingly, in the assembly of the foot member 32, the upper member 42 is connected to the lower member 52 by inserting the foot end wedges 48 through the openings 60. In so doing, protrusions 62 present in the internal surface of the corner deck 58 surrounding the openings 60 snaps into the holes 50 so that the foot member 32 is solidly constructed with the upper member 42 affixed to the lower member 52 with the foot end wedges 48 extending downwardly from the foot member 32.

Figure 3:
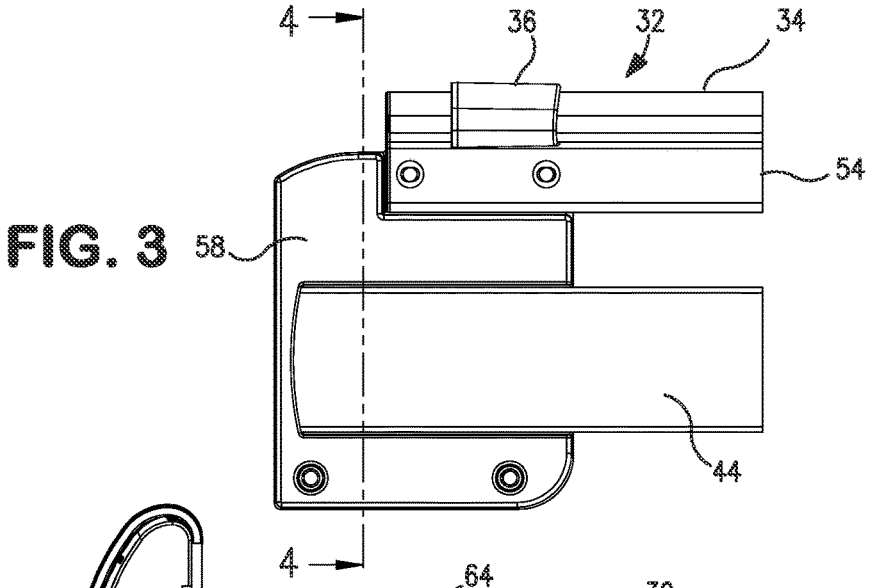
FIG. 3 is a top view illustrating an end of the foot member.

Turning then to FIG. 3, there is a top view of one of the ends of the foot member 32. In this view, there can be seen the upper flange 44 of the T-shaped structural member as it is fitted into corner deck 58. Also shown is the protective shield 34 that covers the angle iron 54.

Figure 4:
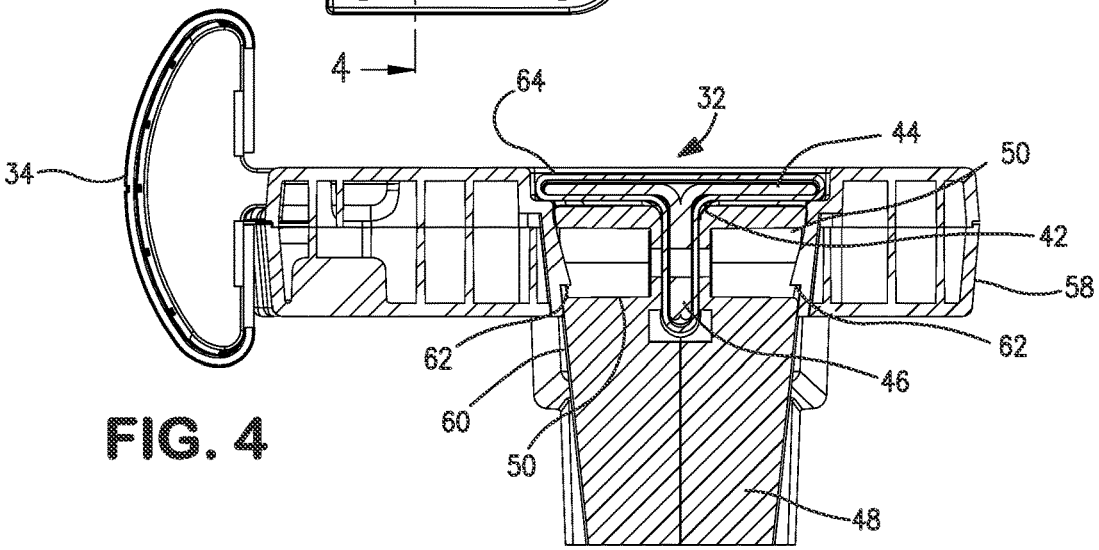
FIG. 4 is a cross-sectional view of an end of the foot member taken along line 4-4 of FIG. 3.

FIG. 4 is a cross-sectional view of the junction of the foot member 32 taken along the line 4-4 of FIG. 3 and illustrates the position of the T-shaped upper member 42 with the foot end wedge 48 depending downwardly therefrom and passing through the opening 60 in the corner deck 58. Also shown are the protrusions 62 that are formed in the inner surface of the opening 60 that snap into the holes 50 to firmly retain the upper member 42 to the corner deck 58.

Figure 5:
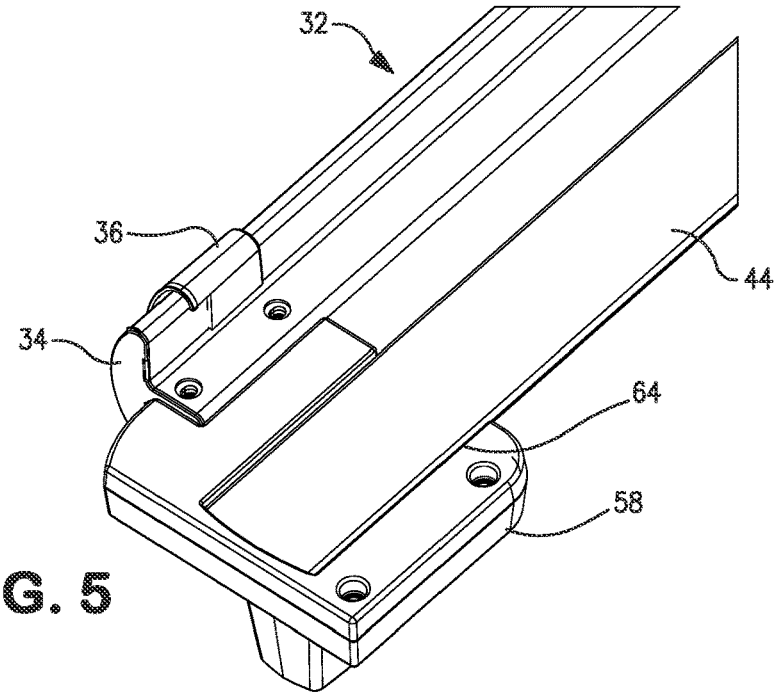
FIG. 5 is a perspective view of an end of the foot member.

Turning then to FIG. 5, taken along with FIGS. 3 and 4, there is a perspective view of an end of the foot member 32 and illustrating the fitting of the upper flange 44 of the upper member 42 into a similarly dimensioned slot 64 in the corner deck 58, thereby presenting a flat surface for seating of the box spring.

Figure 6A:
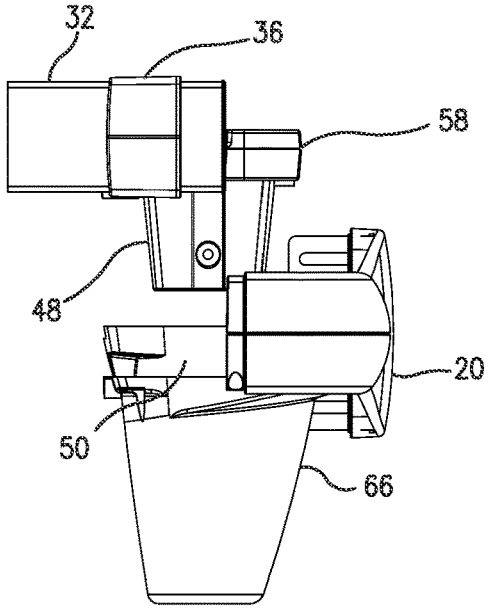
FIGS. 6A, 6B and 6C are side views illustrating the progressive steps in the attachment of the foot member to the side rail of the FIG. 1 embodiment.
Figure 6B:
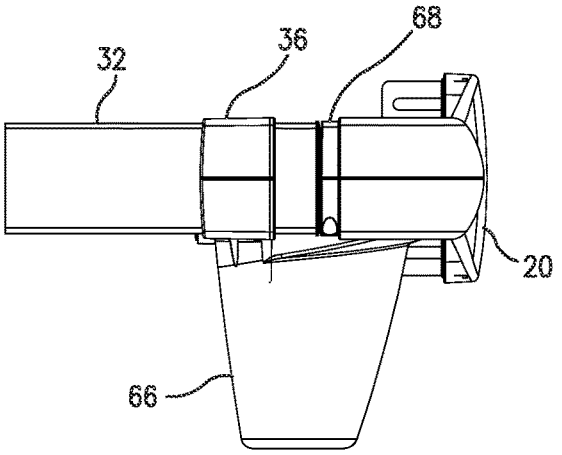
Figure 6C:
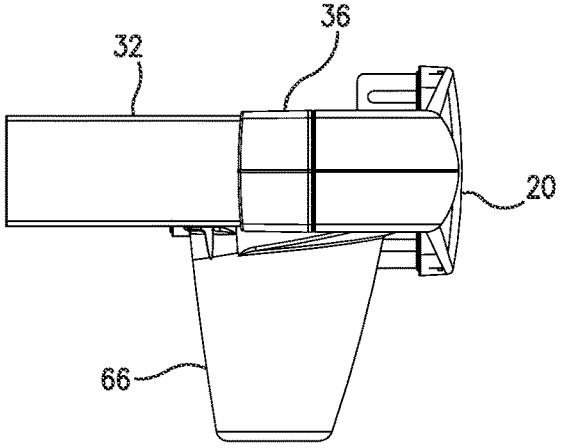

Turning then to FIGS. 6A, 6B and 6C, there are end views illustrating the assembly or affixation of the foot member 32 to the foot end receivers 66. As such, in FIG. 6A, the foot member 32 is positioned just above the foot end receiver 66 to be lowered in making the connection. In FIG. 6B, the foot member 32 has been lowered such that the foot end wedge 48 has passed through the opening 50 and is seated within the foot end receiver 66.

As shown, particularly in FIG. 6B, there is a gap 68 between the foot member 32 and the foot end receiver 66 due to variations in the dimensions and tolerances in the fabrication of the components. The movable slide 36 in FIG. 6B is in its open position such that the gap 68 is uncovered. As a final step, in FIG. 6C, the movable slide 36 is slid into a closed position where it covers the gap 68 to provide a final overall pleasing appearance.

Figure 7:
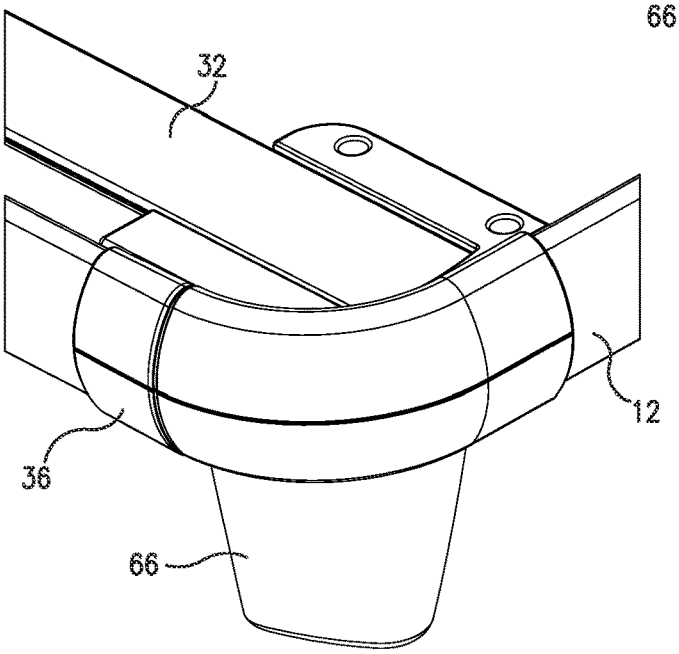
FIG. 7 is a perspective view of a completed assembly of the foot member to the side rail in the FIG. 1 embodiment.

Accordingly, in FIG. 7, there is a perspective view of the completed junction of a foot member 32 with the foot end receiver 66 and, correspondingly, with a side rail 12.

Figure 8A:
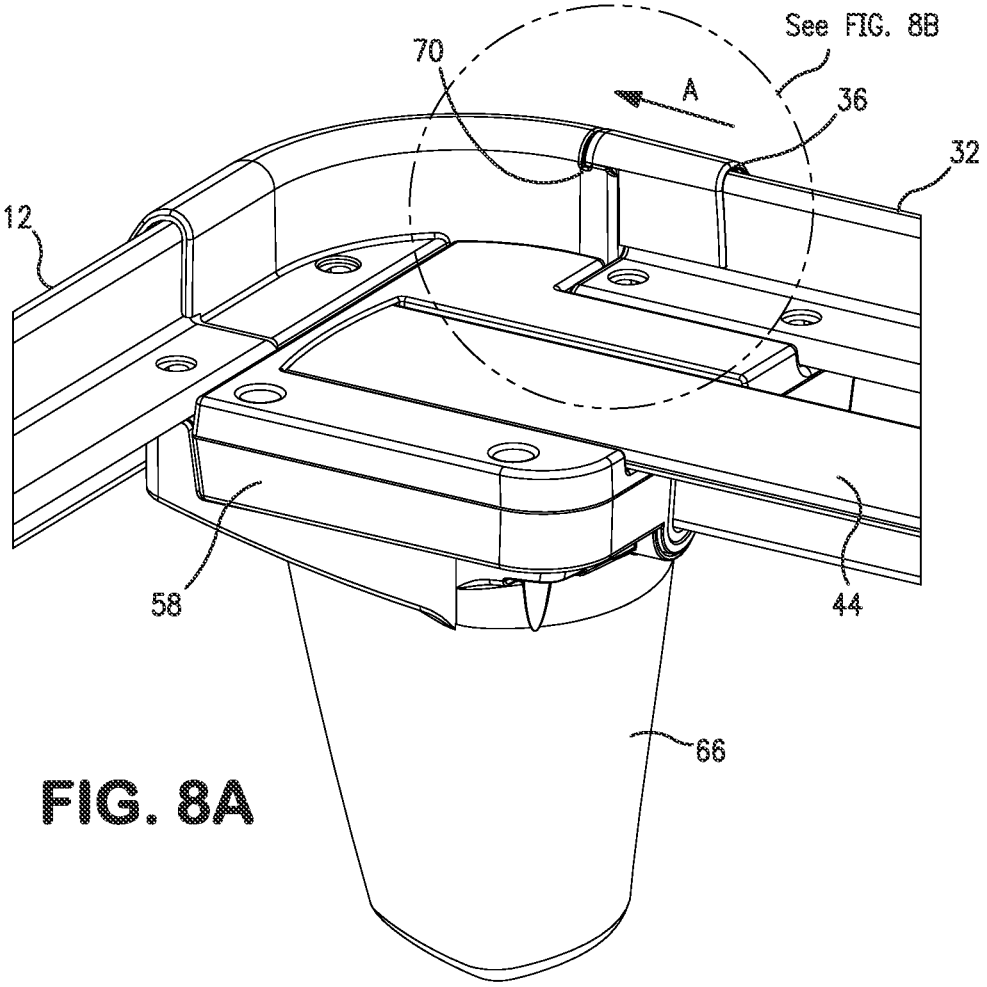
FIGS. 8A and 8B are a perspective view, and an enlarged perspective view, respectively, of a foot member affixed to a side rail.
Figure 8B:
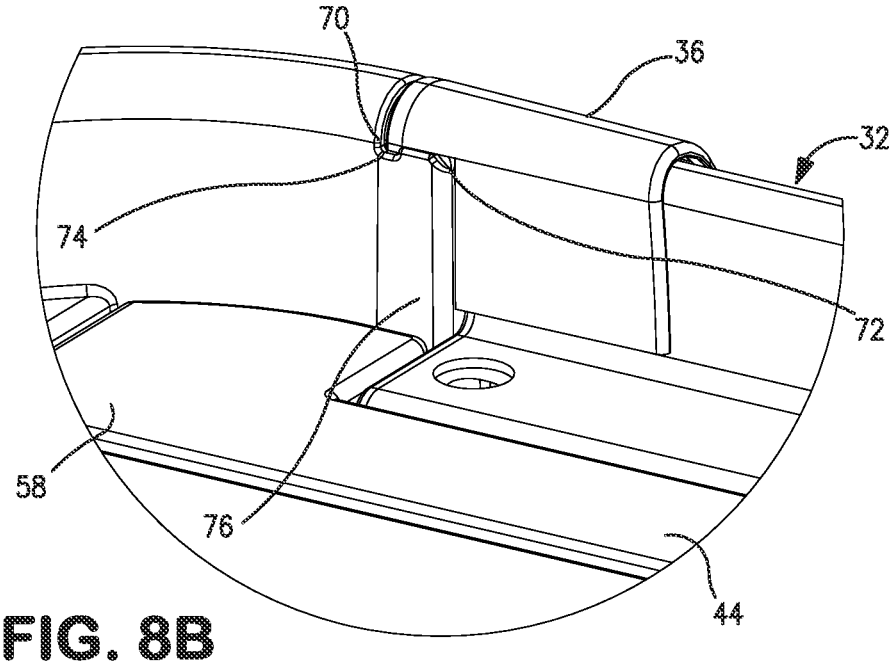

Turning then to FIGS. 8A and 8B, there is a perspective view and an enlarged perspective view, of a foot member 32 affixed to a side rail 12 by means of the coupling between the foot member 32 and a corner deck 58 that is, in turn affixed to a side rail 12 as previously explained. As can be seen, the foot member 32 is in position and the movable slide 36 has been moved to its closed position straddling the gap 68 (see FIG. 6B) between the foot member 32 and the curved end of the side rail 12.

In moving the movable slide 36 to its closed position, the movable slide 36 is moved in the direction of the arrow A and has a tooth 70 at its distal end. The tooth 70 at that distal end progresses along a slight ramp 72 progressing upwardly, and, at the end of that ramp 72, there is a pocket 74 into which the tooth 70 drops, thereby retaining the movable slide 36 in its final position. In a preferred embodiment, the ramp 72 and the pocket 74 may be incorporated into a plug 76 that interfits into the open end of the foot member 32 and which also eliminates the otherwise sharp end of that foot member 32.

Figure 9:
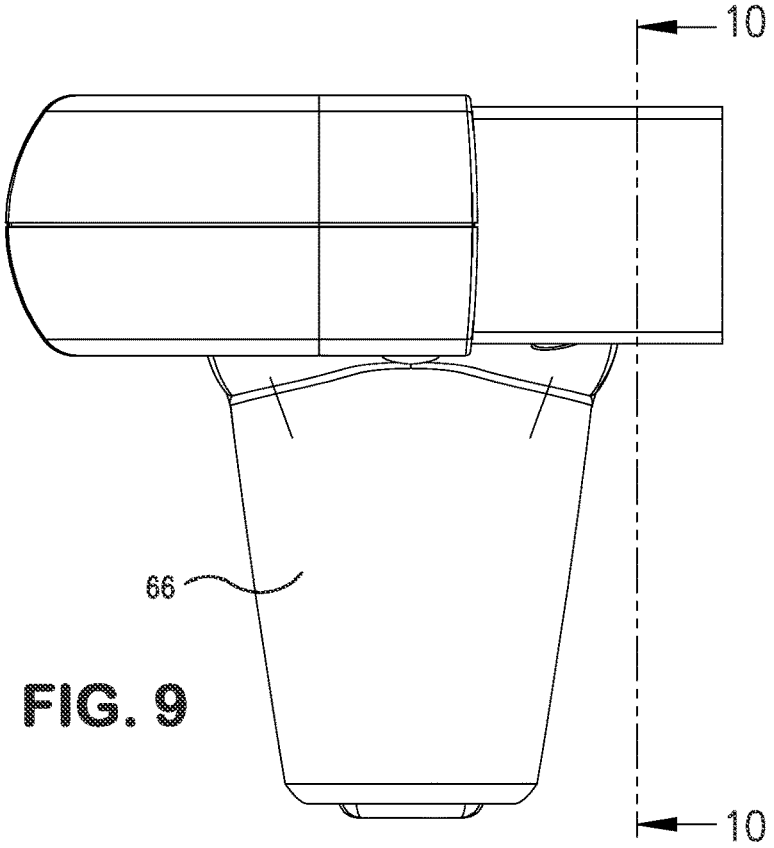
FIG. 9 is an end view of the connection between a side rail and a foot member.
Figure 10:
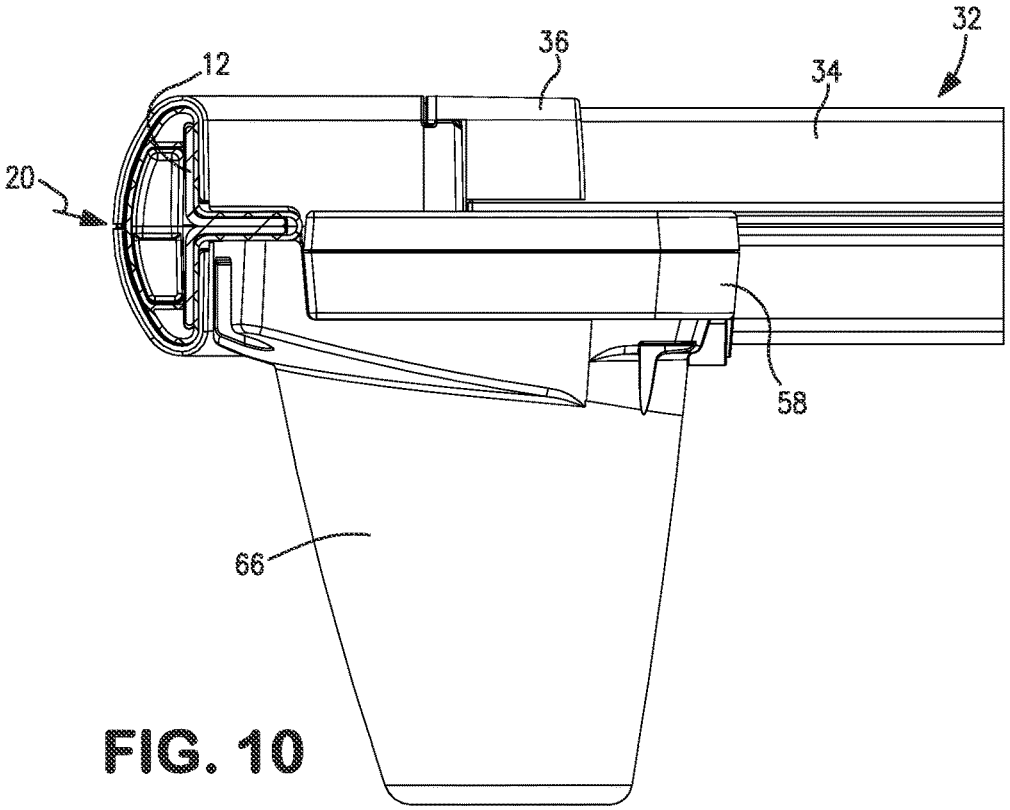
FIG. 10 is a cross sectional view of the connection between a side rail and a foot member taken along line 10-10 of FIG. 9.

Turning to FIG. 9, there is an end view of the connection between a side rail 12 and a foot member 32 and FIG. 10 is a cross sectional view taken along the lines 10-10 of FIG. 9. In these Figures, it can be seen that the movable slide 36 is in its closed position covering the slot (FIG. 6B) and the corner deck 58 fits down upon the foot end receiver 66 to provide a strong connection.

Again, as explained in the Summary of the Invention, the present invention can include a head member that is affixed between the head ends of the side rails so that the head end of the bed frame is finished off in a manner the same as the foot end as described in the present patent application. As such, the head member can have wedges affixed thereto that interfit into receivers provided in the head end of the side rails and eliminate the head board brackets as well as an attached headboard. Such an arrangement can provide additional support to the head end of the bed frame as well as create an attractive appearance.

While the present invention has been set forth in terms of a specific embodiment of embodiments, it will be understood that the present wrap around bed frame and components therefore herein disclosed may be modified or altered by those skilled in the art to other configurations. Accordingly, the invention is to be broadly construed and limited only by the scope and spirit of the claims appended hereto.

What is claimed is:

1. A bed frame assembly for supporting a mattress or mattress set, the bed frame assembly comprising side rails having foot ends and having at least one receiver affixed thereto, at least one cross member spanning between the side rails, the at least one cross member having ends with end wedges extending downwardly therefrom, the end wedges being interfitted into a receiver, a foot member affixed to the foot ends of the side rails to provide support for the mattress or mattress set, the foot member having foot end wedges extending downwardly therefrom to be interfitted into a receiver to join the side rail and support the bed frame;

wherein the foot member is comprised of an upper member and a lower member affixed together; and wherein the lower member has corner decks located at each end thereof having an opening therein and the upper member includes the foot end wedges that pass through the openings when the upper member is affixed to the lower member.

2. The bed frame assembly of claim 1 wherein the upper member and lower member are snap fitted together.

3. The bed frame assembly of claim 2 wherein the foot end wedges have holes formed therein and the corner decks have protrusions that snap into the holes when the upper member is affixed to the lower member.

4. The bed frame assembly of claim 1 wherein a gap is created between the foot member and the side rail when affixed together and movable slides are slidingly affixed to the ends of the foot member.

5. The bed frame assembly of claim 4 wherein the movable slides are movable between an open position and a closed position where the movable slide is positioned spanning the gap.

6. The bed frame assembly of claim 4 wherein each movable slide has a distal end with a tooth formed therein and wherein the tooth interfits into a pocket provided on the side rail when the movable slide is in its closed position.

7. The bed frame assembly of claim 6 wherein there is a ramp formed on the side rail and the tooth rides up the ramp when moving to its closed position immediately prior to interfitting into the pocket.

8. The bed frame assembly of claim 7 wherein the ramp and the pocket are formed in a plug that is located in an open end of the foot member.

9. The bed frame assembly of claim 1 wherein at least one cross member has a center wedge extending downwardly about midway between the ends of the cross member and a foot is affixed to the wedge.

10. The bed frame assembly of claim 9 wherein the foot is snap fitted to the center wedge.

11. The bed frame assembly of claim 1 wherein the cross members and the foot member are attached to the side rails by vertical downward movement.

12. A bed frame assembly for supporting a mattress or mattress set, the bed frame assembly comprising side rails having foot ends and head ends, each side rail having a receiver affixed thereto at the head end, the foot end and at least one receiver intermediate the head end and foot ends, a foot member affixed to the foot ends of the side rails to provide support for the mattress or mattress set, the foot member having wedges extending downwardly therefore to be interfitted into receivers affixed to the side rails to join the side rails, a head member affixed to the head ends of the side rails, the head member having wedges extending downwardly therefrom to be interfitted into receivers affixed to the side rails to join the side rails and at least one cross member spanning between the side rails intermediate the head end and the foot end, the at least one cross member having ends with wedges extending downwardly therefrom, the wedges being interfitted into receivers affixed to the side rails to join the side rails;

wherein the foot member is comprised of an upper member and a lower member affixed together;

wherein the lower member has an opening formed therein and the upper member has a wedge that passes through the opening; and wherein the upper member and lower member are snap fitted together.

* * * * *